US007273008B2

(12) United States Patent
Giori et al.

(10) Patent No.: US 7,273,008 B2
(45) **Date of Patent: *Sep. 25, 2007**

(54) INTEGRATED INSTALLATION AND METHOD FOR TREATING SHEETS OF PRINTED PAPER

(75) Inventors: Fausto Giori, Lausanne (CH); Johannes Georg Schaede, Wurzburg (DE)

(73) Assignee: KBA-Giori S.A., Lausanne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/436,017

(22) Filed: May 17, 2006

(65) Prior Publication Data

US 2006/0249040 A1 Nov. 9, 2006

Related U.S. Application Data

(63) Continuation of application No. 10/275,467, filed as application No. PCT/CH01/00269 on Apr. 30, 2001, now Pat. No. 7,096,784.

(30) Foreign Application Priority Data

May 8, 2000 (CH) ..... 906/00

(51) Int. Cl.
*B41F 13/24* (2006.01)

(52) U.S. Cl. ..... 101/232; 101/216

(58) Field of Classification Search ..... None
See application file for complete search history.

(56) References Cited

U.S. PATENT DOCUMENTS

| | | | | |
|---|---|---|---|---|
| 3,118,665 | A * | 1/1964 | Thompson et al. | 271/176 |
| 3,774,535 | A * | 11/1973 | Crissy | 101/142 |
| 3,988,571 | A * | 10/1976 | Blair et al. | 235/379 |
| 4,677,910 | A | 7/1987 | Kuhfuss | |
| 4,793,251 | A | 12/1988 | Kuhfuss | |
| 5,429,044 | A | 7/1995 | Giori et al. | |
| 5,598,006 | A | 1/1997 | Stringa | |
| 5,618,378 | A | 4/1997 | Cahill | |
| 5,758,244 | A * | 5/1998 | Iwakura | 399/313 |
| 6,036,187 | A * | 3/2000 | Schaede | 271/204 |
| 6,192,140 | B1 * | 2/2001 | Reinhard et al. | 382/112 |
| 6,302,016 | B1 * | 10/2001 | Fausto et al. | 101/118 |
| 6,595,130 | B2 | 7/2003 | Uehara | |

FOREIGN PATENT DOCUMENTS

| | | |
|---|---|---|
| EP | 0668577 A1 | 8/1995 |
| EP | 0985548 A1 | 3/2000 |

* cited by examiner

*Primary Examiner*—Anthony H. Nguyen
(74) *Attorney, Agent, or Firm*—Crompton, Seager & Tufte, LLC

(57) ABSTRACT

The invention concerns an installation comprising means controlling printing quality supplied by a printed sheet feeding device. Downstream, printing means print serial numbers and/or affix other elements. The quality of the number printing is controlled by a control device. A transfer device transports the sheets to a stock of three stacks one of which collects the defective sheets. A marking device affix a mark on the sheets considered unsuitable during the quality control.

19 Claims, 4 Drawing Sheets

INTEGRATED INSTALLATION AND METHOD FOR TREATING SHEETS OF PRINTED PAPER

The present application is a continuation of prior filed U.S. application Ser. No. 10/275,467, filed May 7, 2003, now U.S. Pat. No. 7,096,784 which is the National Stage of International Application No. PCT/CH01/00269, filed Apr. 30, 2001.

FIELD OF THE INVENTION

The present invention is in the field of means adapted to produce characters or designs on surfaces. More specifically, the present invention relates to machines having rotary means and which sort and selectively print on articles and selectively deliver related articles in groups in a separate position.

BACKGROUND OF THE INVENTION

The present invention relates to an apparatus and method for treating sheets of paper printed on both sides, especially papers of value, comprising a sheet-by-sheet feed device, transfer means, means for treating said sheets, and means for separation into at least two separate stacks, and to a method for operating this installation. Installations for printing papers of value, such as checks, security papers and bank notes, are becoming increasingly sophisticated in order to prevent forgeries that are becoming easier to produce using the improved reproduction means currently available. The principal steps in printing papers of value are the following: printing, on both sides of sheets of paper or a reel of paper, depending on the different printing techniques, checking of the printing quality of the sheets thus obtained, numbering and affixing of other additional elements such as, for example, a signature on papers regarded as meeting the quality criteria, formation of stacks with sheets containing papers of value corresponding to the quality criteria, and formation of a stack with sheets regarded as unacceptable and optionally formation of a stack with sheets that have not undergone the desired treatment following stoppages or errors in the treatment. Thereafter, the sheets with the papers of value regarded as acceptable are cut into individual papers of value and sorted in order to form bundles numbered in sequence. There is also the possibility that the numbering of the papers of value is carried out after cutting and not before.

SUMMARY OF THE INVENTION

The present invention relates to one particular field of this production sequence, namely the treatment of the sheets after printing and intended to be checked and numbered. Usually, installations for treating printed sheets are installations comprising devices which carry out only part of this treatment, namely one installation checks the printing quality and separates the acceptable sheets from the unacceptable sheets, another installation does the numbering and another one the printing of additional elements such as a signature, date, etc., and another one checks the numbered sheets before or after cutting (usually on a sheet there are n rows and n columns of separate elements) and so on. The object of the present invention is to provide a installation for carrying out several or part of these operations for a single installation.

The installation according to the present invention is characterized in that it comprises means for checking the printing quality, means for printing a sequential number and/or additional elements, means for checking the numbering and/or for printing additional elements, and means for marking the sheets found to be unacceptable by one of the quality checking means. This installation has the advantage of making it possible, in a single pass, to carry out the operations of checking quality, of printing a sequential number and/or additional elements, of checking the quality of this printing, and of marking the sheets found to be unacceptable and of guiding them toward a suitable stack.

According to a variant, a device for verifying that the unacceptable sheets have been marked may be provided in order to improve the efficiency of the installation. According to another variant and in the case of each sheet consisting of n columns and m rows of separate printed elements, the sequential numbering is carried out only on the sheets for which all the elements have been found to be acceptable. According to still another embodiment, the sequential numbering is carried out on all the elements regarded as being acceptable, the numbering devices printing a special mark on the elements regarded as being unacceptable upon being checked for quality. According to a further variant, the means for checking the printing quality comprise a device for checking the presence and quality of elements invisible to the naked eye.

The quality of the printed sheets is checked by devices which may be of different types depending on the precision of the desired inspection and also on the type of image to be checked. Thus, for example, the quality of black-and-white printing may be checked by machines that inspect both the entire sheet or an entire paper of value, while a meticulous inspection of a color image involves the inspection of a sheet of paper or of a paper of value row by row. It is obvious that the devices used are of different design, construction and cost. Hitherto, the users of such machines have purchased a installation according to type of inspection, which of course poses a purchase cost problem but also a problem of the space occupied by such machines. Moreover, some machines for checking the quality of bank notes use linear transfer means on which the sheets of paper lie flat, said sheets passing in front of devices for checking the quality by reflection off a face, and also a device for checking quality in transmission. This type of installation, like that for example described in EP-A-0 668 577 by the same Applicant, occupies a relatively large amount of space in the horizontal direction since the sheets run past three cameras on a flat transfer device. The other object of the present invention is to provide, in the installation, a device for checking printing quality on both sides of a sheet in transmission, which occupies a relatively restricted horizontal space. Another object is to be able to modify the type of checking, that is to say to replace the optoelectronic devices used for rapidly checking quality so as not to stop the production line for a long period in order to make the modifications that would be needed in order to replace various optoelectronic apparatuses.

This device for checking quality included in the installation according to the invention is characterized in that said device comprises a first group of rotary sheet-seizing members rotating about a first axis and a second group of rotary sheet-seizing members rotating about a second axis, parallel to the first, the rotation of the two groups being in opposite directions and in synchronism, passage of a sheet from the first group to the second taking place along a contact generatrix of the circular paths described by said members so that each sheet follows approximately an S-shaped path, thus making it possible to present in succession each of its sides to two optoelectronic reflection-based checking means, so that one of the optoelectronic reflection-based checking means is located between the circular path traveled by a sheet about one of the axes of rotation and said axes, and so that the other optoelectronic reflection-based checking means is located between the circular path traveled by a sheet about the other axis of rotation and said axis, the optoelectronic transmission-based checking device also being located on the inside of one of said circular paths and the corresponding axis of rotation.

The advantages of this device according to the invention are the fact that the sheets to be checked, instead of them moving along flat transfer means, move along an S-shaped path formed in fact by two circular arcs, thereby allowing it to occupy a relatively short horizontal space and using a space in the vertical direction to perform the checking. Moreover, the fact of housing the optoelectronic checking apparatuses inside each of the arcs traveled by the sheets also makes it possible to save overall space since the apparatuses are inside a space which in any case would remain unoccupied. The seizing members of each group can either lie on the lateral surface of an apertured drum or be fastened to arms driven by a shaft coaxial with the axis of rotation.

According to a preferred variant of this quality checking device, the members for seizing the sheets are supported by a wall of a stand located perpendicular to said axes of rotation, while the optoelectronic checking means are supported by an element of a moveable parallel wall that is opposed to the first wall, provided with means for being able to be moved parallel to the axis of rotation and to gain access to said optoelectronic means, either for their maintenance or for their replacement with other optoelectronic means. According to another embodiment, the quality checking device may comprise two moveable wall elements, which makes it possible, after having removed the first wall element, to replace it with the second, and in this way to be able to change the type of bank note quality checking without stopping the device for a relatively lengthy period.

Finally, this installation may be operated according to various methods of implementation, that is to say it is perfectly possible to use the installation to carry out only a check of the printing quality of the images, and in this case all that is required is to deactivate the means for printing the additional elements or the numbering while leaving the sheets to follow the same path, or to carry out only numbering, by deactivating the optoelectronic checking means, the sheets still following the same path but without undergoing any printing quality check. In this way, a multipurpose installation is obtained, allowing, as required, either a complete treatment to be carried out, that is to say a quality check, printing of numbering and optionally of an additional element, a check of the printing quality of the numbering and separation into separate stacks of acceptable and unacceptable sheets, or only a check of the printing quality of the image to be carried out without numbering, or simply numbering to be carried out without a quality check, but still using the same installation. In addition, there is the possibility of modifying the type of printing quality check; for example it is possible to use a row-by-row quality check or a check of the entire sheet.

DETAILED DESCRIPTION OF THE INVENTION

Figure 1:
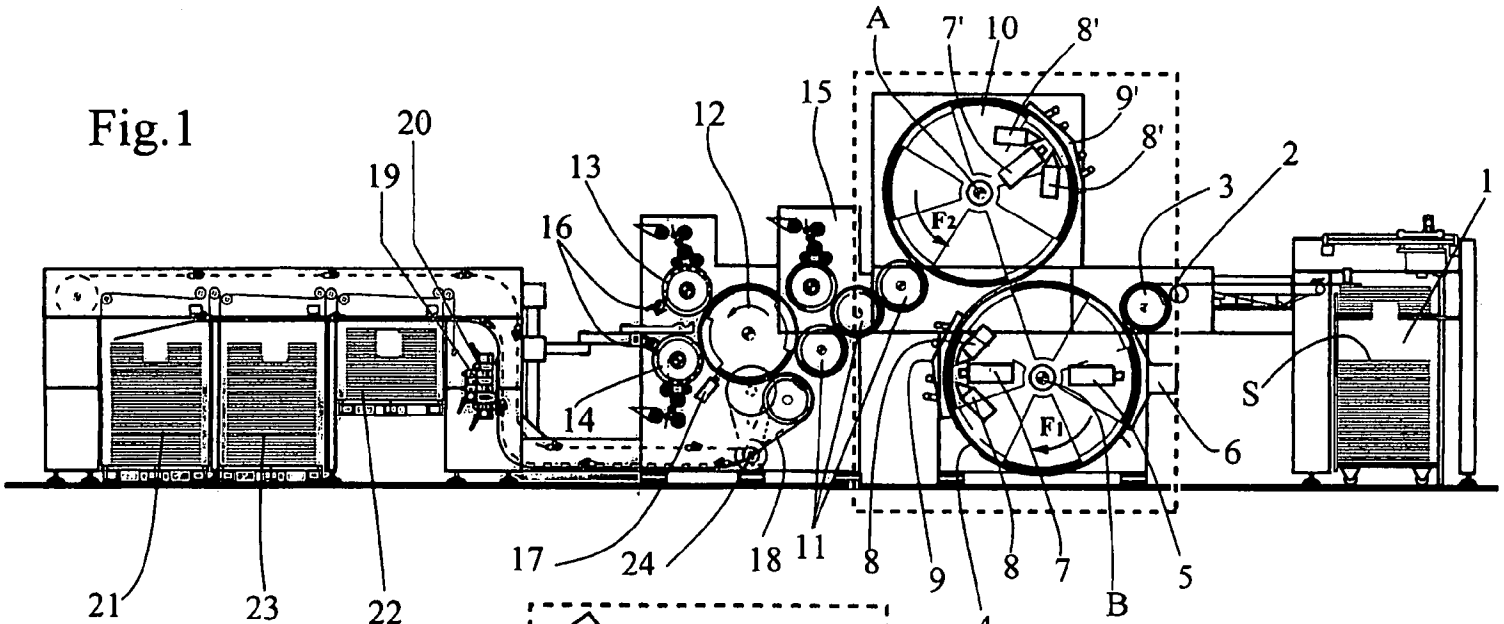
FIG. 1 shows, in a schematic side view, a installation for treating papers of value.

Referring now to the drawings, the details of preferred embodiments of the present invention are graphically and schematically illustrated. Like elements in the drawings are represented by like numbers, and any similar elements are represented by like numbers with a different lower case letter suffix.

The installation shown in FIG. 1 firstly comprises a feed device 1 for printed sheets S of paper, for example papers of value such as bank notes. These sheets S enter a transfer drum 3 via a feed roll 2 and are taken up by a first drum 4 driven in rotation in the direction of the arrow F1. Said drum is provided with grippers for seizing the front end of a sheet. The drum 4 is apertured so that it is possible to carry out the various quality checks. This is because it is necessary to be able to see the surface of the seized sheet from inside the drum 4. In a first position inside the drum 4 we have a camera 5 which makes it possible to check by transmission, and facing this camera outside the drum there is a device 6 for illuminating the sheet on its opposite side.

Thereafter, the sheet continues its travel in the direction of the arrow F1 and arrives so as to face an optoelectronic reflection-based checking device 7 illuminated by devices 8, the sheet being held in a regular configuration by a suction device 9. In the present case, the quality check is made row by row as the drum 4 rotates past the quality checking device 7. Thereafter, when the sheet arrives at the point of contact between the drum 4 and a drum 10, the sheet is taken by a seizing device from the drum 10, and goes past another optoelectronic reflection-based checking device 4', the sheet being illuminated by an illumination device 8', and a row-by-row quality check is also carried out as before, the sheet being held in a regular manner by a suction device 9'. Of course, the drum 10' rotates in the direction of the arrow F2, which is the opposite direction to that of the arrow F1, thereby making it possible, as the sheet S passes from the drum 4 to the drum 10, to change the side of the sheet that is turned toward the inside of the drum 10. The drum 10 has a construction very similar to that of the drum 4. Thereafter, the sheet passes via a series of transfer rolls 11, and a printing roll 12 on which two elements 13 and 14 act, for numbering or for affixing alphabetical elements. Each of the printing elements 13 and 14 is inked by an inking assembly which does not form part of the present invention. The rolls 13 and 14 are also provided with a cleaning device, as is standard practice in this type of installation. Secondarily, an additional unit 15 may be provided for printing an additional element such as, for example, a signature and/or a date, on papers of value before they pass to the numbering station.

The use of "smart," and therefore electronic, numbering machines makes it possible to have sequential numbering either on all the elements or papers of value of an acceptable sheet or on the acceptable elements or papers of value of all the sheets. Thus, if it is possible to number all the elements regarded as being acceptable after checking, the scrap is reduced. In addition, it is possible to print a special mark for the numbering machine on the unacceptable elements, which mark may, for example, be a series of lines. When only sheets regarded as being acceptable are numbered, the numbering machines are deactivated during passage of an unacceptable sheet, for example by releasing the pressure on the numbering rolls. This makes it possible to maintain the correct sequence, even with non-electronic numbering machines.

After the sheets have been numbered, they run past an optoelectronic device 17 for checking the printing quality of the numbering. Next, the sheet S is taken up by a chain transfer device 18 and the sheet runs past a marking device 19. This device 19 applies a mark to the upper part of the sheets that have been found to be defective, either during the quality check of the printing by reflection or transmission, or by the device for checking the printing quality of the numbering. A device 20 checks whether the sheets regarded as being unacceptable have indeed been marked by the device 19 and thereafter the sheets are directed toward a stacking device. It has a first stack 21 for the sheets regarded as being good, a stack 22 for the sheets regarded as being scrap and finally it may have a third stack 23 which either it also contains sheets regarded as being good, or they may contain sheets that have not been checked or numbered following inopportune stoppages of the installation or errors during the treatment and that these sheets must pass through the installation one more time.

It should be emphasized that one important point of this installation is the fact that all the elements are in perfect register, that is to say that the various elements are driven in synchronism, for example by means of a central motor 24 which, by means of a toothed wheel and, for example, cogged timing belts, makes it possible to drive the entire installation in perfect synchronism, an unquestionable requirement as regards the proper running of such a installation.

Figure 2:
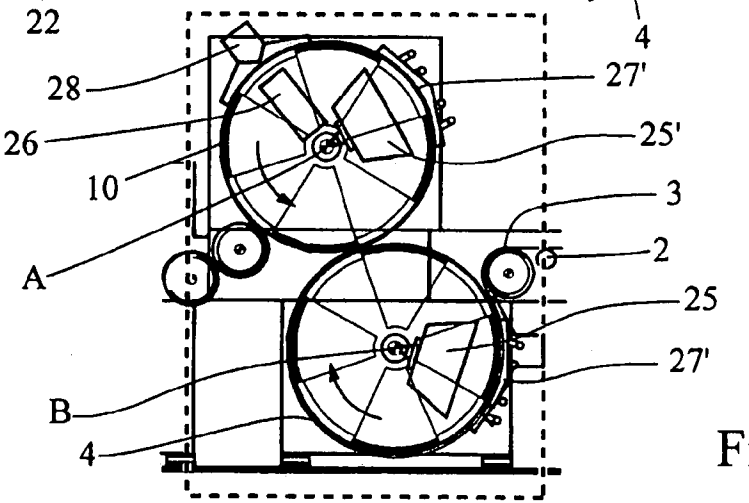
FIG. 2 is a view of an embodiment of the bank note checking device.

In FIG. 2 we have shown the part surrounded by dotted lines of the installation in FIG. 1 relating to another type of check of the printing quality. In the present case, the paper feed elements 2 and 3 are identical, as are also the drums 4 and 10, the only differences relating to the system for checking the sheaths of paper by reflection. Thus, a first optoelectronic device 25 makes it possible to scan the entire sheet in one go, that is to say a less precise quality check used in particular for black-and-white printing. Another similar device 25' makes it possible to check the other side of a sheet. The transmission-based quality checking device 26 is this time inside the upper drum. It is obvious that the sheets are held in a regular position facing the quality checking device 25 and 25' by suction devices 27 and 27'. A device 28 makes it possible to illuminate the sheet from the other side in order to check the quality by light transmission.

Details regarding the construction of the drums 4, 10 and also the elements for making the entire installation move in synchronism will be found in the Applicant's parallel patent application filed on the same day at the Federal Institute of Intellectual Property in Switzerland. need cite to this if we are going to rely on it, or we need to include the relevent text and figures. The drums 4, 10 may also be replaced with devices for seizing the end of a sheet and making them rotate about an axis A or B, like those described in the aforementioned patent application.

The installation described in FIG. 1 is in its most complete form and it makes it possible, from a stack of sheets S, to carry out firstly a check of the printing quality by reflection and by transmission, followed by complementary printing, for example, by means of the assembly 15, the affixing of a signature or a date, or both, followed by numbering, thereafter a check of the printing quality, transfer past a device affixing a mark on the sheets having a defect, followed by a device checking that a mark has indeed been affixed to the sheets regarded as being unacceptable during a quality check, and then a stacking device for separating the acceptable sheets from those that are not and optionally from those that have not been treated, whether not checked or not numbered.

It was mentioned above that a check with lower requirements may be made, for example for black-and-white images in relation to the device described in FIG. 2. It is also possible to use this installation to carry out only some of the operations. For example it is very possible to carry out only the quality check and to dispense with numbering the papers of value; in this case, all that is required, without touching the arrangements of the various elements of the machine, is to deactivate only the elements applying printing to the sheets, that is to say a sheet S will follow the same path through all the elements but it will undergo only a quality check by reflection of both its surfaces and by transmission, and it will then pass through the other devices in order to be conducted either to a stack containing the sheets regarded as being acceptable, or to the stack containing sheets regarded as being unacceptable.

Likewise, it is possible to use this installation only for numbering and for affixing an additional element, without the prior quality check being made, and in this case the operation of the optoelectronic checking devices, that is to say the elements 5, 7, 8, 7', 8', are deactivated and in the other case the elements 25, 25' and 26 are deactivated, thereby allowing the sheets to pass over the drums 4 and 10 but without undergoing a quality check and thereafter to come to the additional printing device for the numbering or the affixing of another element, before being finally guided toward one of the stacks 21, 22, 23.

Figure 3:
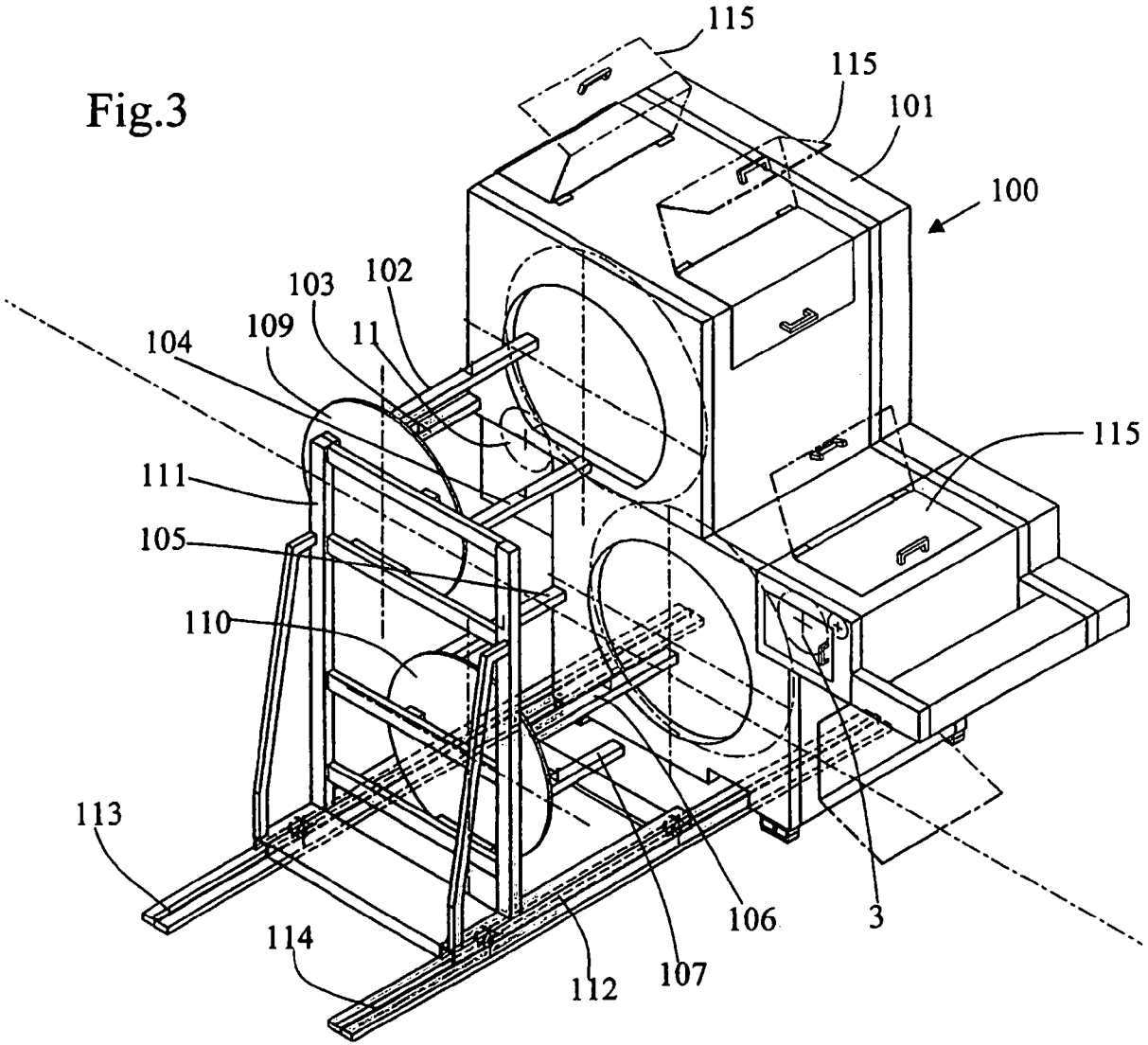
FIG. 3 is schematic perspective view of the bank note checking device with a removable wall element.

FIG. 3 shows a stand 100 having a first wall 101 inside which the various elements shown inside the dotted frame of FIG. 1 or FIG. 2 are housed, namely the transfer roll 3, one of the output roll 11 and the drums 4, 10 or equivalent elements as described in the above mentioned parallel patent application. The spindles of the drums or rotating members are fixed to the wall 101 of the stand and the various quality checking devices, which are not shown in this figure, are placed on a movable wall element that can move perpendicular to the wall 101. This wall element is provided with various supports 102, 103, 104, 105, 106, 107 integral with the elements 109 and 110 which are placed on a structure 111, these being mounted on a carriage 112 that moves along a path 113, 114, making it possible to remove all of the optoelectronic means for checking the quality of a sheet to the outside of the stand 100 in order either to carry out maintenance or repair, or to change said optoelectronic checking means, for example for going from those in FIG. 1 to those in FIG. 2, or vice versa. Thus, by removing the frame 111 which constitutes part of the wall parallel and opposed to the 101, it is easy to make the modifications needed to convert the installation of the quality checking device by changing the various elements.

According to an alternative embodiment, it is possible to have two frames 111 with the various elements described, on one of which may be placed the optoelectronic means like those depicted in FIG. 1 and in the other the optoelectronic means like those in FIG. 2. This makes it possible to change the type of checking rapidly by replacing one of the frames 111 with the other, without causing a prolonged stoppage of the installation. The stand 100 is provided with various opening flaps 115 allowing access to various elements located inside the stand 100 in order to make checks or to carry out maintenance.

Figure 4:
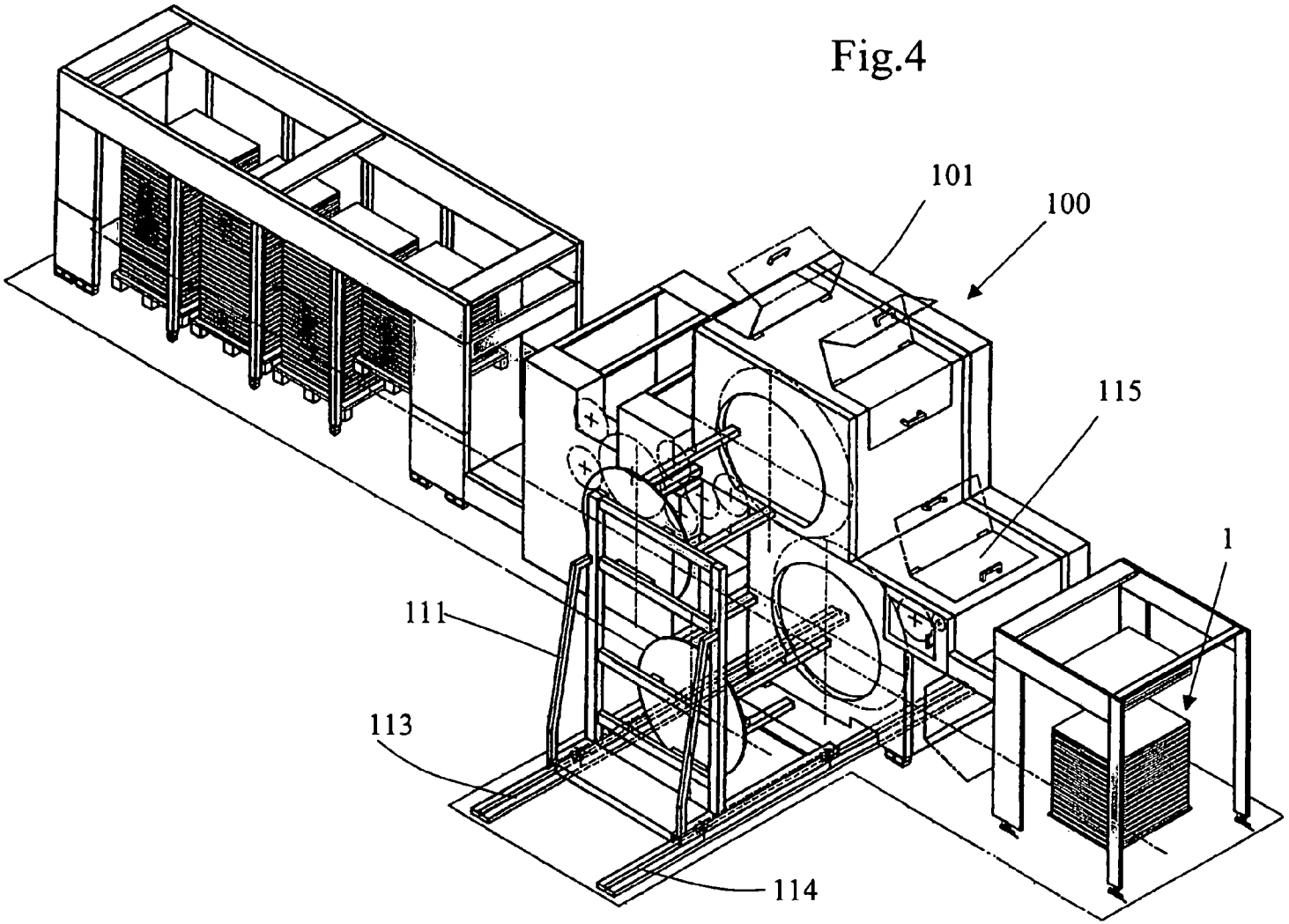
FIG. 4 is a schematic perspective view of a installation that includes the device of FIG. 3.
Figure 5:
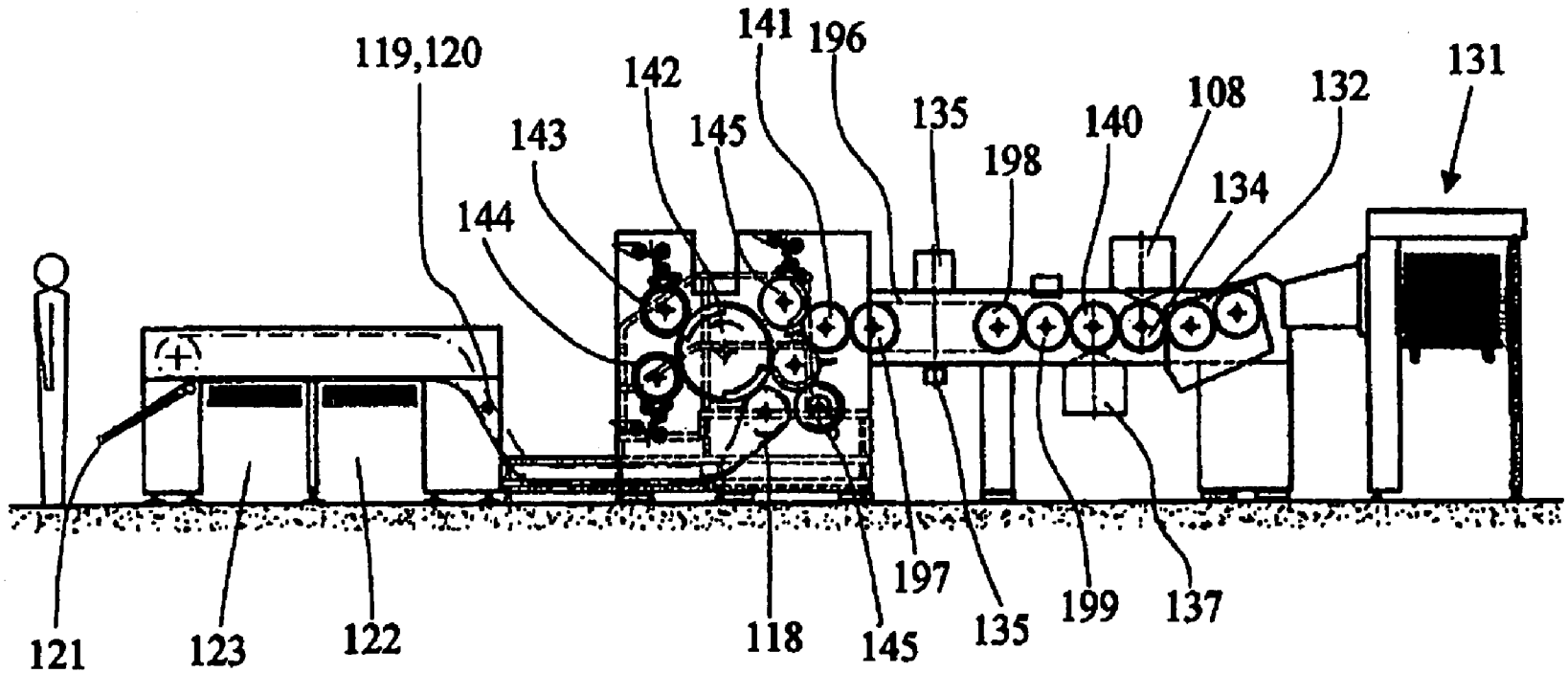
FIG. 5 shows schematically another treatment installation.

In FIG. 4 we have shown, in perspective and schematically, a complete installation corresponding to that of FIG. 1 with the exception that four stacks have been provided at the end, for storing sheets. In this FIG. 4 is shown the device for checking the quality of the sheets with its removable wall.

We will now briefly describe a installation according to the invention having a configuration different from that described above, especially as regards the device for checking the printing quality of bank notes. This installation includes a printed-sheet feed device 101 and two transfer rolls 102 that feed a device for checking the quality of bank notes by reflection of each of the surfaces and by transmission.

Said device is formed from two drums 104, 110. On one side of the drum 104 there is an optoelectronic device 108 for checking the quality by reflection. This device checks that side of the sheet lying toward the outside of the roll 104. A similar device 107, also lying outside the roll 110, checks the other side of the sheet, which also in this case moves along an S-shaped path. Thereafter, the sheet passes via a transfer roll 199 to a transfer device formed from two roll 198 and 197 which drive a transfer device 196 of the conveyor belt or chain type, making it possible for the sheet to run past a transmission-based checking device 105. In the present case, the device for checking printing quality of a sheet on both sides and by transmission is formed by a device which occupies a greater space in the horizontal direction than that used for the previous installation. Thereafter, the sheet passes via a transfer roll 111 to a printing device which is composed, as previously, of a device 115 for printing elements such as a signature, date, etc., in order, thereafter, for the sheet to pass over a printing roll 112 so as to be numbered by the devices 113 and 114. This printing installation is very similar to that of the installation described above. A device for checking the quality of the printing carried out in this device is also provided, but it is not shown in this figure. Thereafter, a chain transfer device 118 conducts the sheets to a device 119, 120 for marking the unacceptable sheets and for verifying that these sheets have been marked. Thereafter, the sheets are stored in stacks 122, 123 if they have been considered to be acceptable or they exit toward a device 121 when the sheets have been considered to be unacceptable.

In the case of this installation, it is also possible to provide an optoelectronic device for verifying the elements that are invisible to the naked eye. This installation may also be operated in the modes described above, that is to say for checking the printing quality of additional elements and numbering, or only for checking quality without numbering, or only numbering without checking quality by reflection or by transmission. In these cases too, all that is required is to deactivate the elements that carry out these functions, thereby also making it possible for this installation to be used in different modes without making essential modifications.

In the present case, if the quality check made by the devices 107, 108 and 105 has to comply with certain criteria, these apparatuses must be replaced with suitable apparatuses as in the case of the previous installation, except that a movable wall supporting these apparatuses has not been provided. Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. An installation for treating sheets of paper printed on both sides, especially papers of value, each having separate printed elements arranged on the sheet in n columns and m rows, said installation comprising a sheet-by-sheet feed device, transfer means, means for treating said sheets, and means for separation of the sheets into at least two separate stacks, wherein said means for treating the sheets comprise a series arrangement of first quality checking means for checking the printing quality of each one of the printed elements on the sheets, printing means located downstream of said first quality checking means for numbering the sheets and/or printing additional elements on the sheets following passage through the first quality checking means, second quality checking means located downstream of said printing means for checking the printing quality of the numbering of the sheets and/or of the additional elements, and marking means located downstream of said second quality checking means for applying a marking on the sheets found to be unacceptable by one said first and/or second quality checking means.

2. The installation as claimed in claim 1, further including a device for verifying that unacceptable sheets have been marked by said marking means.

3. The installation as claimed in claim 1, wherein said printing means comprise a plurality of numbering devices for numbering the sheets and wherein numbering is carried out in sequence by said numbering devices on the printed elements of a sheet, all of the printed elements of which sheet have been regarded as being acceptable following checking of the printing quality by said first quality checking means, the numbering devices being deactivated during passage of a sheet regarded as being unacceptable.

4. The installation as claimed in claim 1, wherein said printing means comprise a plurality of electronic numbering devices for numbering the sheets and wherein numbering is carried out in sequence by said electronic numbering devices on the printed elements which are regarded as being acceptable following checking of the printing quality by said first quality checking means, the printed elements regarded as being unacceptable being marked by the electronic numbering devices with a special mark.

5. The installation as claimed in claim 1, wherein said first quality checking means comprise optoelectronic devices designed to check the printing quality of each sheet by reflection, on each side of a sheet, and by transmission.

6. The installation as claimed in claim 1, wherein said first quality checking means comprise optoelectronic means for checking presence and quality of elements provided on the sheets, which elements are invisible to the naked eye.

7. A method of operating the installation as claimed in claim 1, wherein said printing means located downstream of said first quality checking means are deactivated so as to use the installation only for checking the printing quality of the sheets.

8. A method of operating the installation as claimed in claim 1, wherein said first quality checking means for checking the printing quality of the sheets are deactivated so as to use the installation only for numbering the sheets and/or printing additional elements on the sheets.

9. An installation for treating sheets of paper printed on both sides, especially paper of value, each having separate printed elements arranged on the sheet in n columns and m rows, said installation comprising a sheet-by-sheet feed device for transferring said sheets to a treating means for treating said sheets and a separation means for receiving the treated sheets from the treating means and separating the treated sheets into at least two separate stacks, wherein, the treating means further comprising a serial arrangement of:

a first quality checking means for checking a quality of each one of the printed elements on said sheets and finding acceptable and unacceptable first checked sheets, the first quality checking means having at least one optoelectronic device disposed to check the printing quality of a side of each sheet;

a printing means disposed downstream of the first quality checking means, the printing means for printing an additional element on acceptable first checked sheets;

a second quality checking means disposed downstream of the printing means for checking the printing quality of the additional element of the first checked acceptable sheets and finding acceptable and unacceptable second checked sheets; and a marking and verification means disposed downstream of the second quality checking means for applying a marking on the unacceptable sheets found by the first and second quality checking means, and for verifying that unacceptable sheets have been marked by the marking means.

10. An installation for treating sheets of paper printed on both sides, especially papers of value, said sheets each having separate printed elements arranged on the sheet in n columns and m rows, said installation comprising a sheet-by-sheet feed device, transfer means, means for treating said sheets, and means for separation of the sheets into at least two separate stacks, wherein said means for treating the sheets comprise a series arrangement of first quality checking means for checking the printing quality of each one of the printed elements on the sheets, printing means located downstream of said first quality checking means for numbering the sheets following passage through the first quality checking means, second quality checking means located downstream of said printing means for checking the printing quality of the numbering of the sheets, and marking means located downstream of said second quality checking means for marking the sheets found to be unacceptable by one of said first and/or second quality checking means, and wherein said printing means comprise a plurality of numbering devices for numbering the sheets and wherein numbering is carried out in sequence by said numbering devices on the printed elements of a sheet, all of the printed elements of which sheet have been regarded as being acceptable following checking of the printing quality by said first quality checking means, the numbering devices being deactivated during passage of a sheet regarded as being unacceptable.

11. The installation as claimed in claim 10, further including a device for verifying that unacceptable sheets have been marked by said marking means.

12. The installation as claimed in claim 10, wherein said first quality checking means comprise optoelectronic devices designed to check the printing quality of each sheet by reflection, on each side of a sheet, and by transmission.

13. The installation as claimed in claim 10, wherein said first quality checking means comprise optoelectronic means for checking presence and quality of elements provided on the sheets, which elements are invisible to the naked eye.

14. The installation as claimed in claim 10, wherein said printing means further comprise a unit for printing additional elements on the sheets.

15. An installation for treating sheets of paper printed on both sides, especially papers of value, said sheets each having separate printed elements arranged on the sheet in n columns and m rows, said installation comprising a sheet-by-sheet feed device, transfer means, means for treating said sheets, and means for separation of the sheets into at least two separate stacks, wherein said means for treating the sheets comprise a series arrangement of first quality checking means for checking the printing quality of each one of the printed elements on the sheets, printing means located downstream of said first quality checking means for numbering the sheets following passage through the first quality checking means, second quality checking means located downstream of said printing means for checking the printing quality of the numbering of the sheets, and marking means located downstream of said second quality checking means for marking the sheets found to be unacceptable by one of said first and/or second quality checking means, and wherein said printing means comprise a plurality of electronic numbering devices for numbering the sheets and wherein numbering is carried out in sequence by said electronic numbering devices on the printed elements which are regarded as being acceptable following checking of the printing quality by said first quality checking means, the printed elements regarded as being unacceptable being marked by the electronic numbering devices with a special mark.

16. The installation as claimed in claim 15, further including a device for verifying that unacceptable sheets have been marked by said marking means.

17. The installation as claimed in claim 15, wherein said first quality checking means comprise optoelectronic devices designed to check the printing quality of each sheet by reflection, on each side of a sheet, and by transmission.

18. The installation as claimed in claim 15, wherein said first quality checking means comprise optoelectronic means for checking presence and quality of elements provided on the sheets, which elements are invisible to the naked eye.

19. The installation as claimed in claim 15, wherein said printing means further comprise a unit for printing additional elements on the sheets.

* * * * *